US006241547B1

(12) United States Patent
Fukuda

(10) Patent No.: US 6,241,547 B1
(45) Date of Patent: Jun. 5, 2001

(54) HALF-FITTING PREVENTION CONNECTOR AND METHOD OF PRODUCING SAME

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/389,095

(22) Filed: Sep. 2, 1999

(30) Foreign Application Priority Data

Oct. 5, 1998 (JP) ..... 10-282820

(51) Int. Cl.[7] ..... H01R 13/627
(52) U.S. Cl. ..... 439/352; 439/489
(58) Field of Search ..... 439/350, 351, 439/352, 372, 488, 489

(56) References Cited

U.S. PATENT DOCUMENTS

| | | | | |
|---|---|---|---|---|
| 5,370,543 | * | 12/1994 | Hamada et al. | 439/352 |
| 5,718,596 | | 2/1998 | Inaba et al. | 439/352 |
| 5,791,930 | * | 8/1998 | Tabata et al. | 439/352 |
| 5,820,399 | | 10/1998 | Shirouzu et al. | 439/352 |
| 5,848,912 | * | 12/1998 | Okabe | 439/352 |
| 5,876,230 | * | 3/1999 | Nishide et al. | 439/352 |
| 5,993,238 | * | 11/1999 | Kudo et al. | 439/352 |
| 6,059,597 | * | 5/2000 | Endo et al. | 439/352 |

FOREIGN PATENT DOCUMENTS

| | | | |
|---|---|---|---|
| 197 33 393 A1 | 2/1998 | (DE) | H01R/13/63 |
| 0 583 056 A1 | 2/1994 | (EP) | H01R/31/08 |
| 0 637 102 A1 | 2/1995 | (EP) | H01R/13/627 |
| 5-81967 | 11/1993 | (JP) | H01R/13/639 |
| 10-50408 | 2/1998 | (JP) | H01R/13/639 |

* cited by examiner

*Primary Examiner*—Gary F. Paumen
*Assistant Examiner*—Alexander Gilman
(74) *Attorney, Agent, or Firm*—Sughrue, Mion, Zinn, Macpeak & Seas, PLLC

(57) ABSTRACT

A female connector 1 of a half-fitting prevention connector of the invention includes a connector housing 3*a*, a slider housing 3*b* having a slider receiving portion 4 for slidably receiving a slider 10, and the slider 10 which is molded integrally with the slider housing 3*b* through a pair of hinges 18 and 18 in such a manner that the slider 10 is disposed above the slider housing 3*b*, that is, in a non-use position relative to the slider receiving portion 4 at a front end portion of the connector. Notches 19 for enabling the slider 10 to be inserted into the slider receiving portion 4 from the upper side are formed in an upper portion of a front end portion of the slider receiving portion 4 corresponding to the slider 10.

4 Claims, 8 Drawing Sheets

HALF-FITTING PREVENTION CONNECTOR AND METHOD OF PRODUCING SAME

BACKGROUND OF INVENTION

1. Field of Invention

This invention relates to a connector fitting construction in which a half-fitted condition is positively prevented by a resilient force of a resilient member mounted in at least one of a pair of connectors to be fitted and connected together, and the connector, fitted on the mating connector, is positively locked.

2. Related Art

Usually, various electronic equipments are mounted on a vehicle such as an automobile, and therefore, naturally, various types of female and male connectors are provided at connection ends of various kinds of wires forming wire harnesses or the like.

Various half-fitting prevention connectors, in which a condition of fitting between female and male connectors, can be detected, have been used, and one such example is disclosed in Unexamined Japanese Utility Model Publication Hei. 5-81967.

This conventional half-fitting prevention connector includes a pin-type connector, having a plurality of juxtaposed pin contacts mounted therein,. and a socket-type connector having a plurality of juxtaposed socket contacts mounted therein. A movable cover is mounted on the outer periphery of the female connector for movement back and forth. Spring receiving portions are provided at opposite side portions of this movable cover, respectively, and compression springs are received respectively in these spring receiving portions, and extend in a forward-rearward direction.

In this half-fitting prevention connector, however, although the half-fitted condition can be prevented by the resilient force of the compression springs, there is encountered a problem that when trying to fit the two connectors together while holding the opposite side surfaces of the movable cover with the hand, the movable cover can not be moved, and therefore the efficiency of the fitting operation is low.

The Applicant of the present application has proposed a connector fitting construction (disclosed in Japanese Patent Unexamined Publication No. 10-50408) which solves the above problem.

A female connector 21 (one of two connectors of the half-fitting prevention connector), shown in FIG. 6, comprises a housing 23 which includes a connector housing 23*a*, having a terminal receiving chamber, and an exclusive-use housing (slider housing) 23*b* formed above the connector housing 23*a*, the exclusive-use housing 23*b* forming a slider receiving portion 24 for slidably receiving a slider 30 (described later). Guide grooves 25 for respectively guiding opposite side portions of a body of the slider 30 are formed respectively in opposite side portions of the exclusive-use housing 23*a*, and a spring receiving portion 23*c* of a tubular shape is formed at a rear end of each of the guide grooves 25.

A lock arm 26 is formed integrally with the exclusive-use housing 23*b* at a widthwise central portion thereof, and extends in a fitting direction, the lock arm 26 having an elastic, free end portion. The lock arm 26 has a lock beak 27 formed on an upper surface thereof, and the lock beak 27 has a slanting surface, and a housing lock 28 for retaining engagement with the mating connector is formed on a lower surface of the lock arm at a distal end thereof. Displacement prevention projections 28*a* for preventing the displacement of the lock arm 26 are formed on the upper surface of the lock arm 26, and face away from the housing lock 28. Side spaces 24*a* for receiving part of the slider 30 are formed at opposite sides of the lock arm 26, respectively.

The slider 30 includes an elastic slider arm 32 provided at a generally central portion of the slider body 31, and the slider arm 32 has a pair of abutment projections 34 formed respectively at opposite side portions of a lower surface thereof at a front end thereof. The slider includes a pressing portion 35, which is formed on an upper surface thereof at a rear end thereof, and is operated when canceling the fitting connection, and a slide groove 33 formed in the slider arm 32 and the pressing portion 35. Spring retaining portions 36 for respectively retaining compression springs 29 are formed respectively at opposite side portions of a lower portion of the slider body 31 at the rear end thereof. A displacement prevention portion 37 for prevention the displacement of the lock arm 26 is formed at the front end of the slider body 31.

As shown in FIG. 7, the male connector (the other connector) 22 includes a housing 41 having a terminal receiving chamber, a pair of stopper projections 42, which are formed on a surface of the housing 41 so as to abut respectively against the abutment projections 34 of the slider 30 during the connector-fitting operation, a slanting projection 43, which is provided between the stopper projections 42, and has a slanting surface for flexing the lock arm 26, and an engagement groove 44 which is formed at a rear side of the slanting projection 43 so as to be engaged with the housing lock 28.

When the slider 30, having the compression springs 29 held respectively on the spring retaining portions 36, is pushed into the slider receiving portion 24 of the female connector 21 from the front side thereof as shown in FIG. 6, the slider body 31 moves along the guide grooves 25 toward the rear end of the female connector. At this time, the abutment projections 34, formed at the lower surface of the slider arm 32, are received respectively in the side spaces 24*a* formed respectively at the opposite sides of the lock arm 26. Then, the compression springs 29 are received in the spring receiving portions 23*c*, respectively, and the lock beak 27 is fitted in the slide groove 33, so that the slider 30 is slidably mounted in the female connector.

In this mounted condition, the slider 30 is urged forward by the resilient force of the compression springs 29 as shown in FIG. 7, and the front end of the pressing portion 35 is retainingly held against the lock beak 27 in the slide groove 33, and the displacement prevention projections 28*a*, formed at the distal end of the lock arm 26, abut against the displacement prevention portion 37 formed on the lower surface of the slider 30 at the front end thereof, thereby preventing the upward displacement of the lock arm 26.

Then, when the operation for fitting the female and male connectors 21 and 22 together is started as shown in FIG. 7, the stopper projections 42 of the male connector 22 are inserted respectively into the side spaces 24*a* (see FIG. 6), formed respectively at the opposite sides of the lock arm 26 of the female connector 21, and these stopper projections 42 abut against the abutment projections 34 of the slider 30, respectively. From this time on, the resilient force of the compression springs 29 is produced. At this stage, pin contacts 51, mounted in the male connector 22, are not yet fitted respectively in socket contacts 50 mounted in the female connector 21.

Then, when the fitting operation further proceeds, the slider 30 is pushed rearwardly against the bias of the compression springs 29, so that the housing lock 28, formed at the distal end of the lock arm 26, abuts against the slanting projection 43 of the male connector 22. If the pushing operation is stopped in this half-fitted condition, the female and male connectors 21 and 22 are returned or moved away from each other (that is, in a disconnecting direction opposite to the fitting direction) by the resilient force of the compression springs 29, and therefore such half-fitted condition can be easily detected.

Then, when the fitting operation further proceeds as shown in FIG. 8, the slider arm 22 of the slider 30 is flexed (elastically deformed) upwardly by the lock beak 27, so that the abutting engagement of the stopper projections 42 with the abutment projections 34 of the slider 30 is canceled. Then, under the influence of the compression springs 29, the slider arm 32 slides over the stopper projections 42, and also the housing lock 28, formed at the distal end of the lock arm 26, slides over the slanting projection 43, and is engaged in the engagement groove 44.

Then, the slider 30 is returned to its initial position under the influence of the compression springs 29, so that the displacement prevention portion 37 of the slider 30 abuts against the displacement prevention projections 28*a* of the lock arm 26, as shown in FIG. 9. As a result, the lock arm 26 is locked, and the female and male connectors are held in a completely-fitted condition, and the contacts 50 are completely connected to the contacts 51, respectively.

This completely-fitted condition can be detected through the sense of touch, obtained when the housing lock 28 of the lock arm 26 slides over the slanting projection 43, and also can be easily detected by viewing the position of the returned slider 30.

However, the slider 30 is molded separately from the housing 23 of the female connector 21, and then is mounted in the exclusive-use housing 23*b*. Therefore, the number of molds for molding the above half-fitting prevention connector increases, and besides considerable time and labor are required for arranging the slider in the assembling direction during the assembling operation, which has resulted in a problem that the production cost is high.

SUMMARY OF INVENTION

It is therefore an object of this invention to solve the above problems, and more specifically to provide a half-fitting prevention connector and a method of producing the same, in which a half-fitted condition is positively prevented during the time when fitting a pair of female and male connectors together, and also the production cost can be reduced.

The above object of the present invention has been achieved by a half-fitting prevention connector wherein a half-fitted condition of a pair of connectors is prevented by a resilient force of a spring member received in a housing of one of the two connectors, and a slider is slidably received in the housing, and when the one connector is to be fitted relative to the other connector, the slider cooperates with the spring member to cause a lock arm, provided in the housing, to be retainingly engaged with the other connector; provided in that the slider is molded integrally with the housing through severable hinges.

The above object of the invention has also been achieved by a method of producing a half-fitting prevention connector wherein a half-fitted condition of a pair of connectors is prevented by a resilient force of a spring member received in a housing of one of the two connectors, and a slider is slidably received in the housing, and when the one connector is to be fitted relative to the other connector, the slider cooperates with the spring member to cause a lock arm, provided in the housing, to be retainingly engaged with the other connector; provided in that the slider is molded integrally with the housing through severable hinges in such a manner that the slider is disposed above the housing, and extends in a sliding direction, and subsequently the slider is inserted into the housing, receiving the spring member, with the hinges severed, so that the slider is slidably mounted in the housing.

In the above construction, one housing of the half-fitting prevention connector and the slider are molded in the same mold, and therefore the number of the molds for forming the half-fitting prevention connector is reduced, and also the number of the molded parts is reduced, and therefore the assembling operation is easy, and the production cost can be reduced.

In the half-fitting prevention connector, preferably, the slider is molded integrally with the housing in such a manner that the slider is disposed in a non-use position relative to a slider receiving portion of the housing at a front end portion of the connector, and extends in a sliding direction, and notches for enabling the slider to be inserted into the slider receiving portion from the upper side are formed in an upper portion of a front end portion of the slider receiving portion corresponding to the slider.

In the method of producing the half-fitting prevention connector, preferably, the slider is molded integrally with the housing in such a manner that the slider is disposed in a non-use position relative to a slider receiving portion of the housing at a front end portion of the connector, and extends in the sliding direction, and the slider is inserted into the slider housing through notches formed in an upper portion of a front end portion of the slider receiving portion corresponding to the slider.

With this construction, the hinges can be easily severed merely by pushing the slider into the slider receiving portion from the upper side of the housing, and the slider can be easily mounted slidably within the slider housing, and the assembling operation is further simplified.

DETAILED DESCRIPTION OF PREFERRED EMBODIMENTS

One preferred embodiment of a half-fitting prevention connector of the present invention, as well as a method of producing the same, will now be described in detail with reference to the accompanying drawings.

Figure 1:
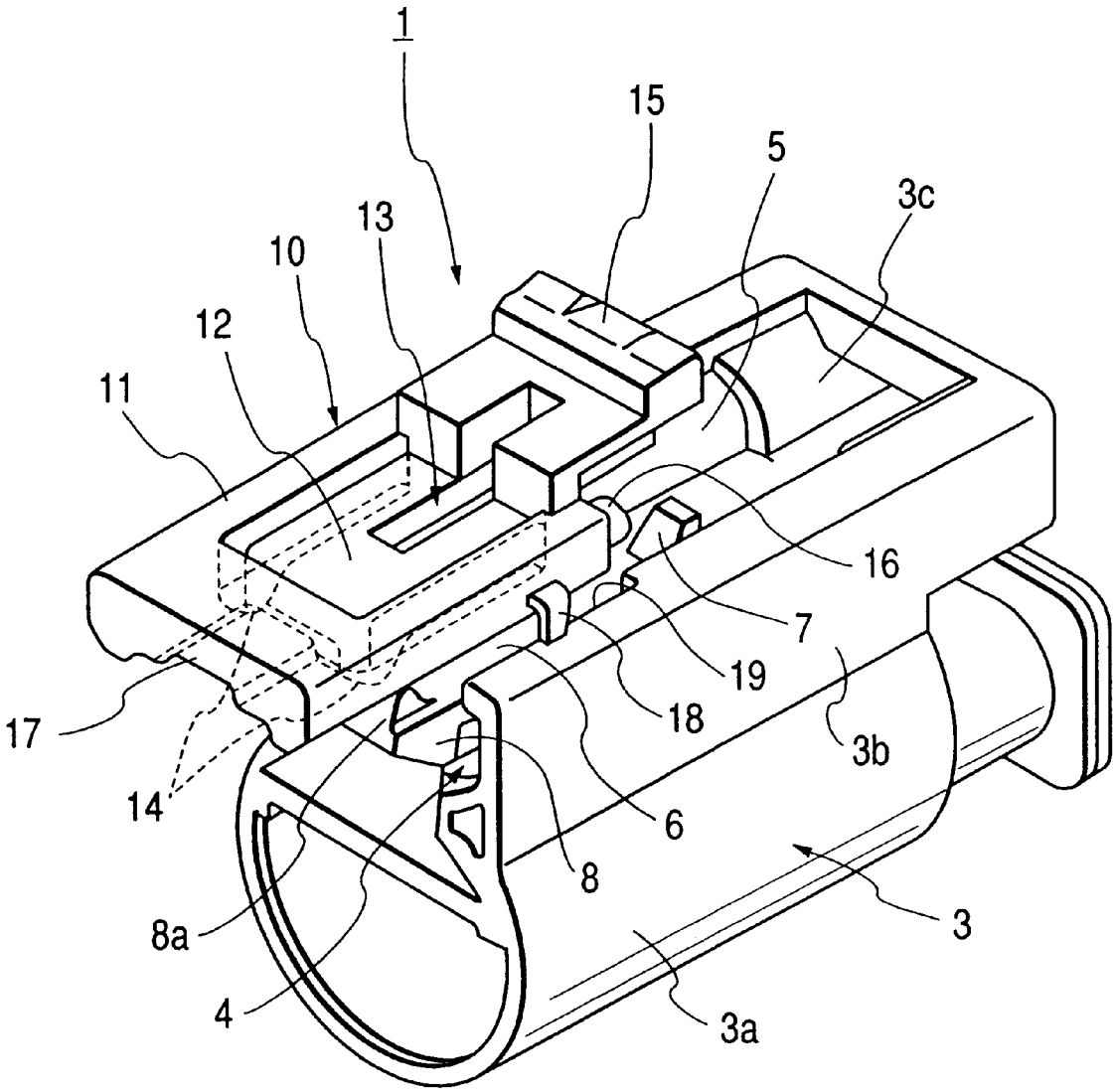
FIG. 1 is a perspective view showing a female connector in one preferred embodiment of a half-fitting prevention connector of the invention.
Figure 2B:
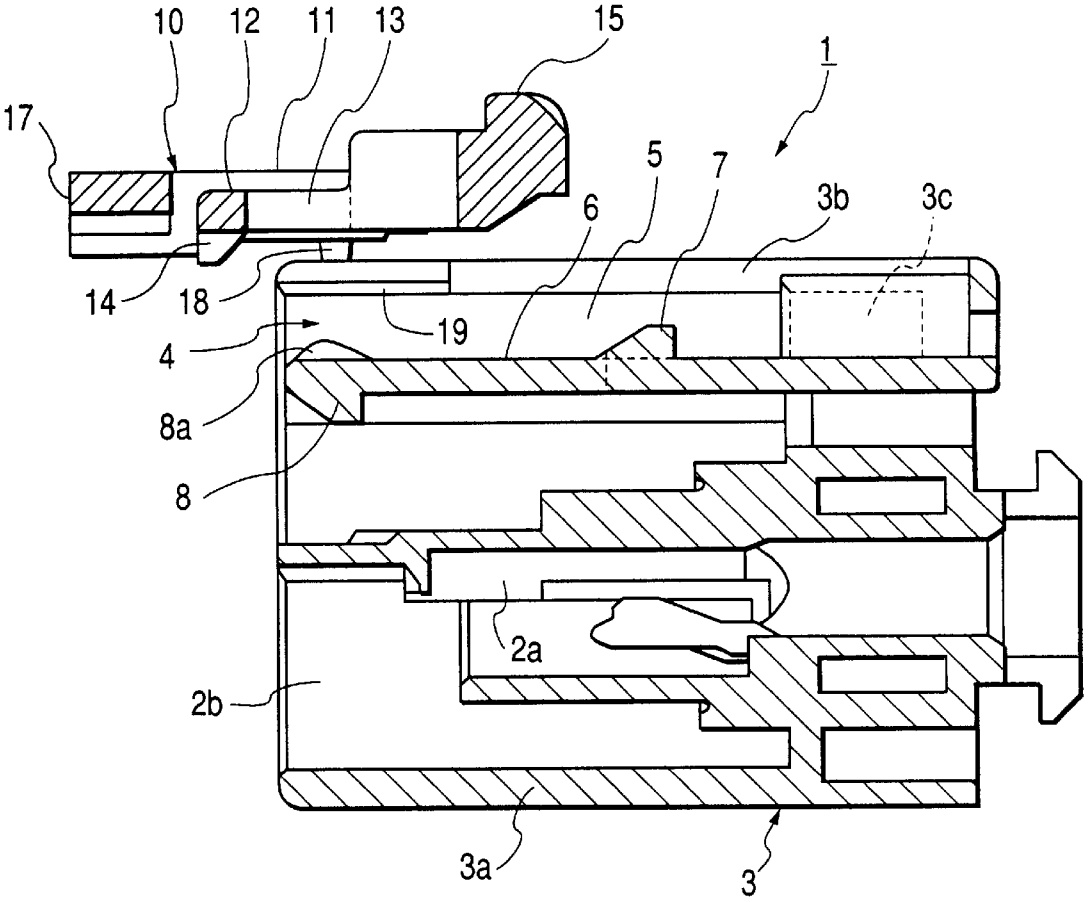
FIG. 2(*a*) is a front-elevational view of the female connector shown in FIG. 1, and FIG. 2(*b*) is a vertical cross-sectional view thereof.
Figure 2A:
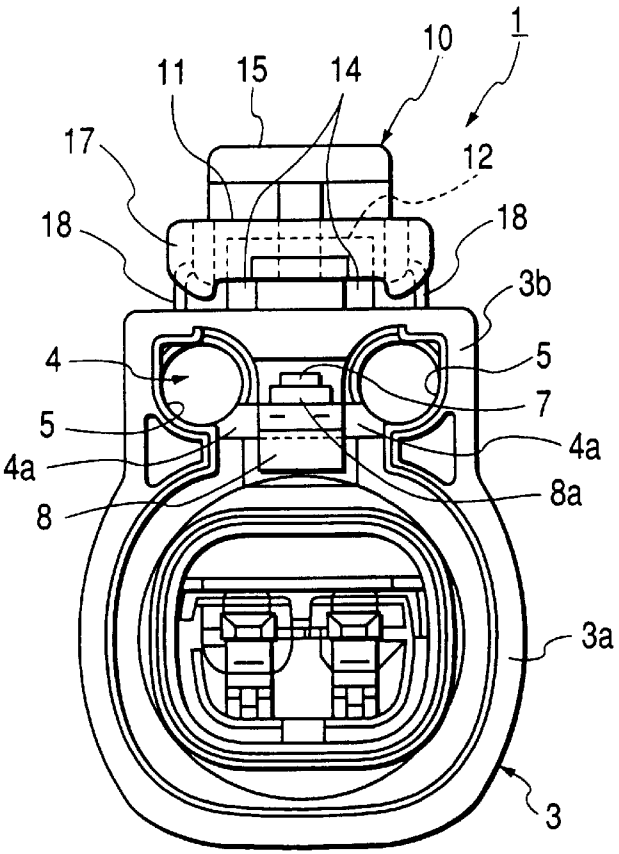

As shown in FIGS. 1 and 2, the female connector 1 (one of the pair of female and male connectors constituting the half-fitting prevention connector of this embodiment) comprises a housing 3, and this housing 3 includes a connector housing 3*a*, which has terminal receiving chambers 2*a* (each in the form of a through hole) for receiving a predetermined number of socket contacts, and also has a terminal insertion port 2*b* open to its front side, a slider housing 3*b* provided above the connector housing 3*a* so as to slidably receive a slider 10 (described later), and the slider 10 which is molded integrally with the slider housing 3*b* through a pair of hinges 18 and 18, and is disposed above the slider housing 3*b*.

The slider housing 3*b* is provided to form a slider receiving portion 4 for receiving the slider 10, and extends in a fitting direction, and is open upwardly. Guide grooves 5 for respectively guiding opposite side portions of a slider body 11 are formed respectively in opposite side portions of the slider housing 3*b*. A spring receiving portion 3*c* of a tubular shape is formed at a rear end of each of the guide grooves 5.

Notches 19 for enabling the slider body 11 to be inserted into the slider receiving portion 4 from the upper side of the housing are formed respectively in opposite side edges of the opening in the slider housing 3*b*. A slanting guide surface is formed on an upper edge of each notch 19.

A lock arm 6 of the cantilever type is formed integrally with the slider housing 3*b* at a widthwise central portion thereof, and extends in the fitting direction. A lock beak 7, having a forwardly downwardly-slanting surface, is formed on an upper surface of the lock arm 6, and a housing lock 8 for retaining engagement with a male housing (not shown) is formed on a lower surface of the lock arm 6 at a distal end thereof. Displacement prevention projections 8*a* for preventing the displacement of the lock arm 6 are formed on the upper surface of the lock arm 6, and face away from the housing lock 8.

Side spaces 4*a* for respectively receiving abutment projections 14 of the slider 10 (described later) are formed at opposite sides of the lock arm 6, respectively.

The slider 10 is molded integrally with the housing 3 through the pair of severable, thin hinges 18 and 18 each interconnecting the upper surface of the slider housing 3*b* and a respective one of the opposite side surfaces of the slider body 11. The slider 10 includes an elastic slider arm 12 provided within the slider body 11 at a generally central portion thereof, and this slider arm 12 has the pair of abutment projections 14 and 14 formed respectively at opposite side portions of a lower surface thereof at a front end portion thereof. The slider also includes a pressing portion 15, which is formed on an upper surface thereof at a rear end thereof, and is operated when canceling the fitting connection, and a slide groove 13 formed in the slider arm 12 and the pressing portion 15. Spring retaining portions 16 for respectively retaining compression springs 9 are formed respectively at opposite side portions of a lower portion of the slider body 11 at the rear end thereof. A displacement prevention portion 17 for preventing the displacement of the lock arm 6 is formed at the front end of the slider body 11.

Figure 6:
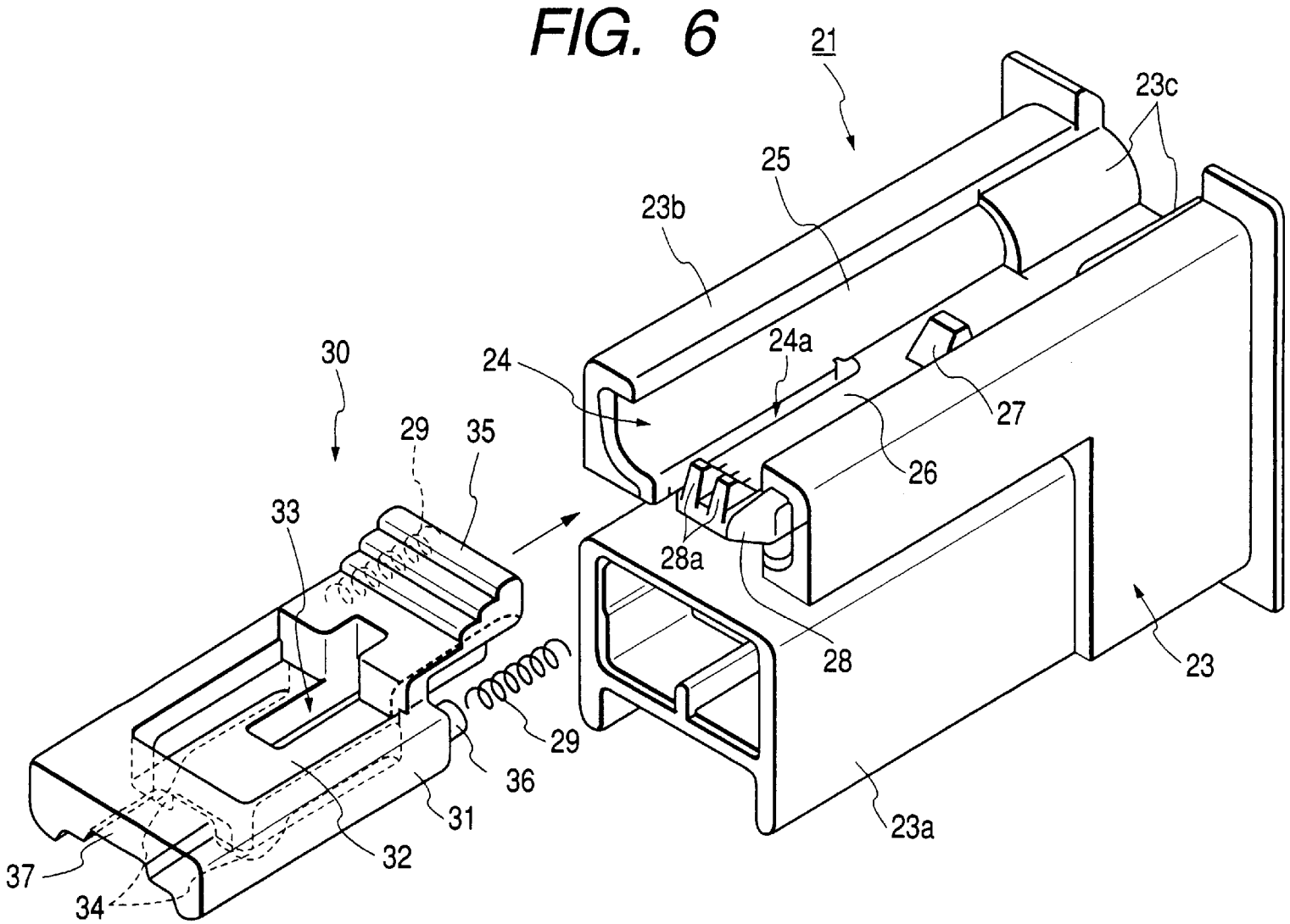
FIG. 6 is an exploded, perspective view of a female connector of a conventional half-fitting prevention connector.

Namely, in the female connector 1, the housing 3 and the slider 10 can be molded in the same mold, and therefore the number of the mold is smaller as compared with the female connector 21 of FIG. 6 in which the housing 23 and the slider 30 are molded separately from each other, and therefore the production cost can be reduced.

Figure 7:
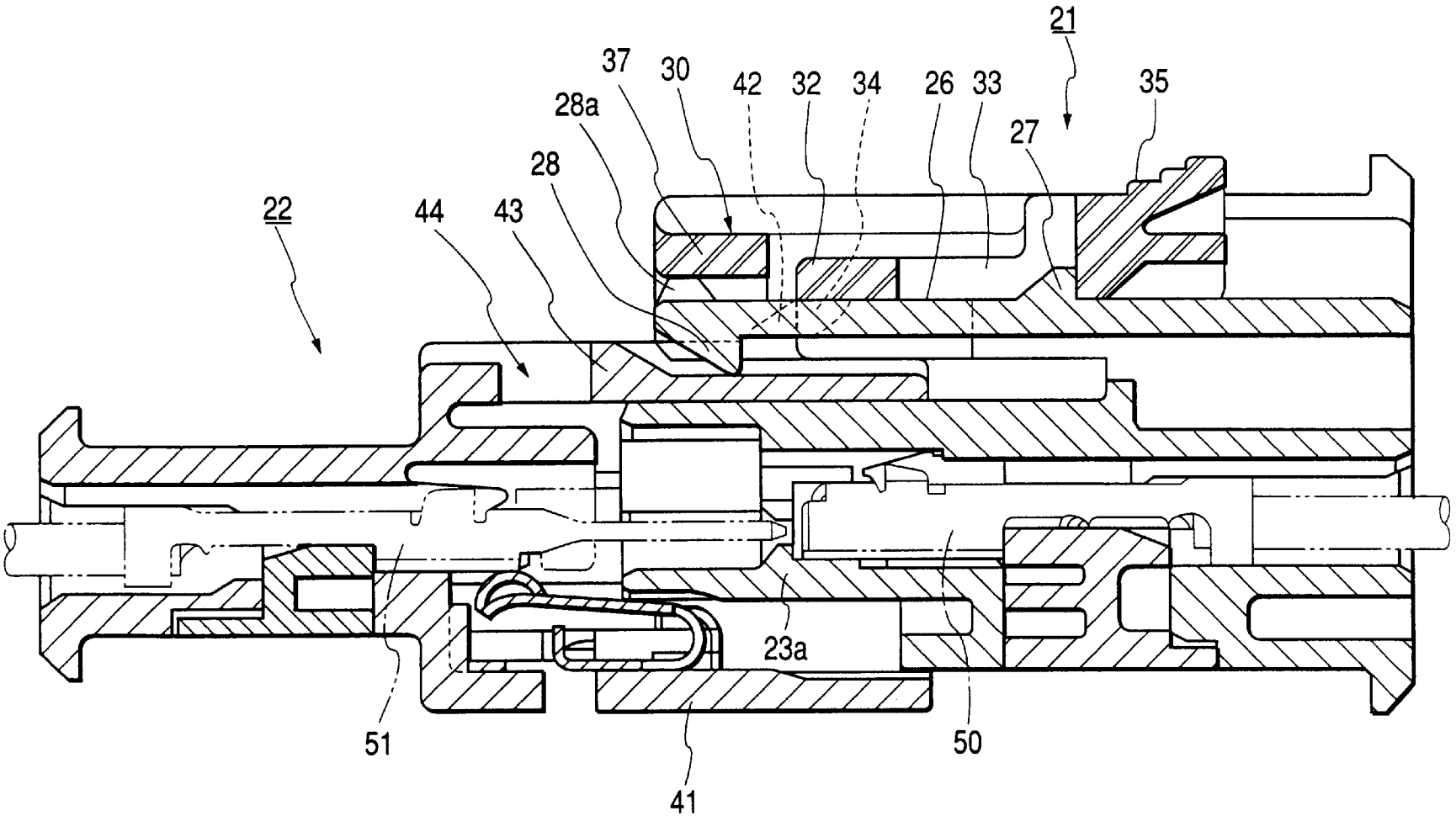
FIG. 7 is a view explanatory of an operation, showing an initially-fitted condition of the conventional half-fitting prevention connector.
Figure 8:
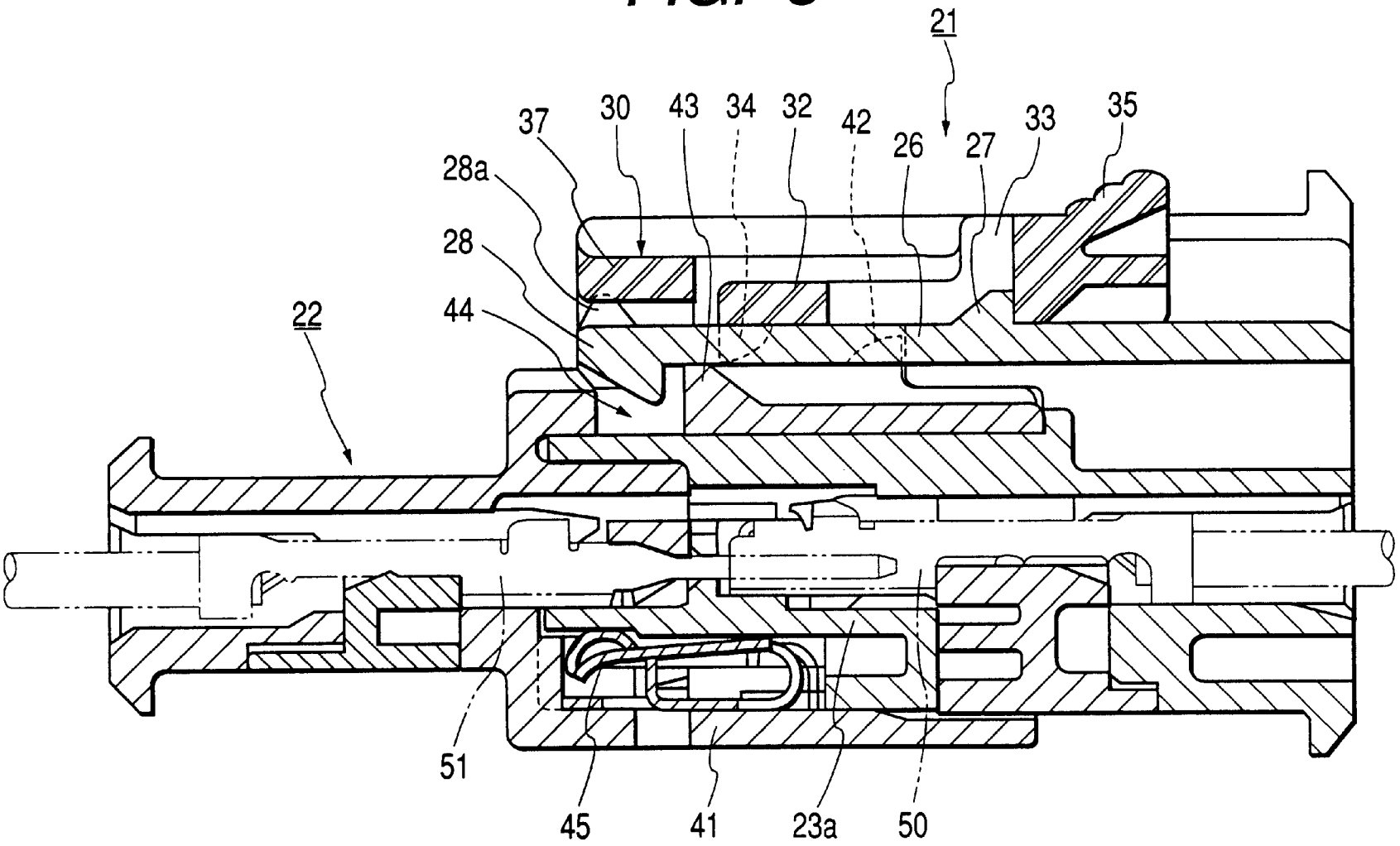
FIG. 8 is a view explanatory of the operation, showing a half-fitted condition of the conventional half-fitting prevention connector.
Figure 9:
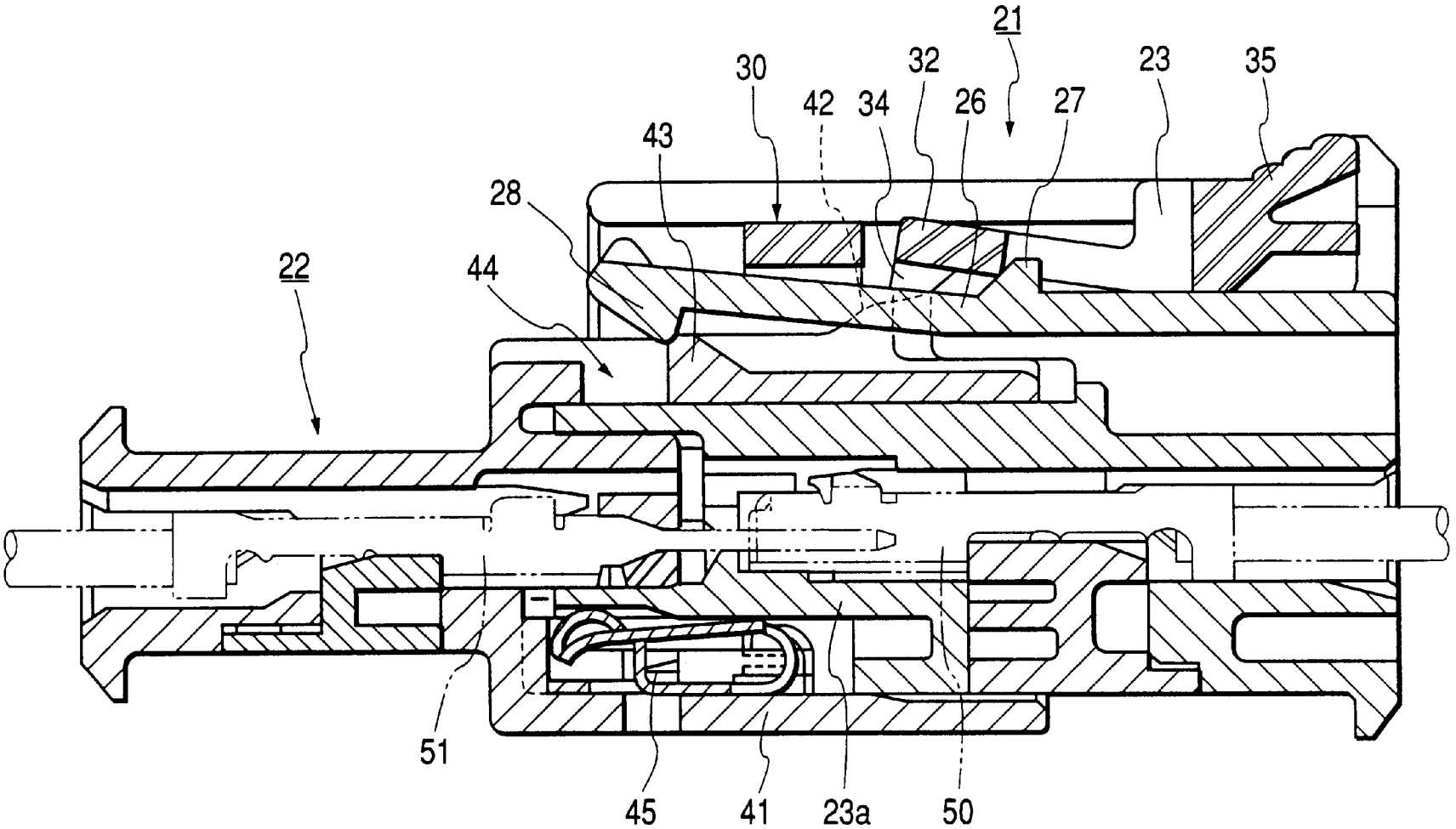
FIG. 9 is a view explanatory of the operation, showing a completely-fitted condition of the conventional half-fitting prevention connector.

Like the male connector 22 of FIG. 7, the male connector (not shown) includes a pair of stopper projections, which are formed on a surface of its housing so as to abut respectively against the abutment projections 14 of the slider 10 during the connector-fitting operation, a slanting projection, which is provided between these stopper projections, and has a slanting surface, and an engagement groove which is formed at a rear side of this slanting projection so as to be engaged with the housing lock 8.

Next, a procedure of assembling the female connector 1 of the above construction will be described.

As shown in FIGS. 1 and 2, the slider 10 is molded integrally with the housing 3 through the pair of hinges 18 and 18 in such a manner that the slider 10 is disposed in a non-use position relative to the slider receiving portion 4 of the slider housing 3*b* at the front end portion of the connector, and extends in a sliding direction.

Figure 3B:
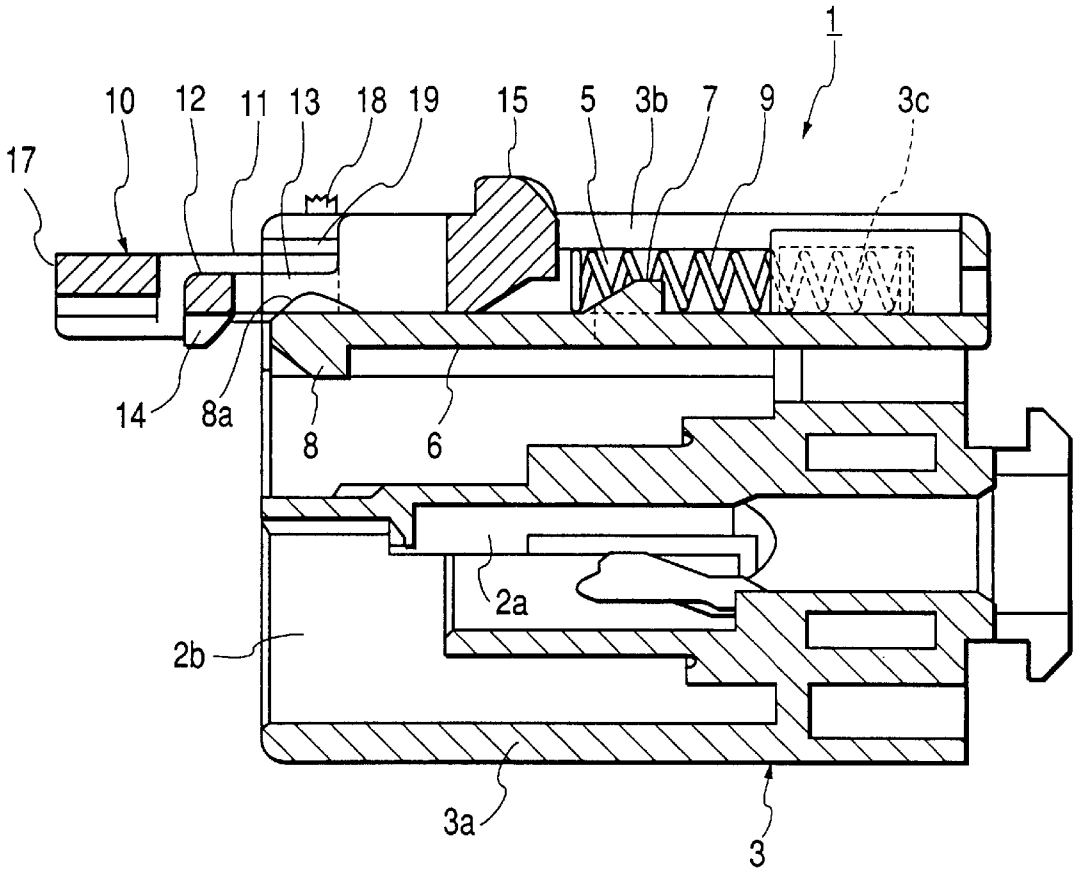
FIG. 3(*a*) is a front-elevational view explanatory of a process of mounting a slider shown in FIG. 1, and FIG. 3(*b*) is a vertical cross-sectional view showing this process.
Figure 3A:
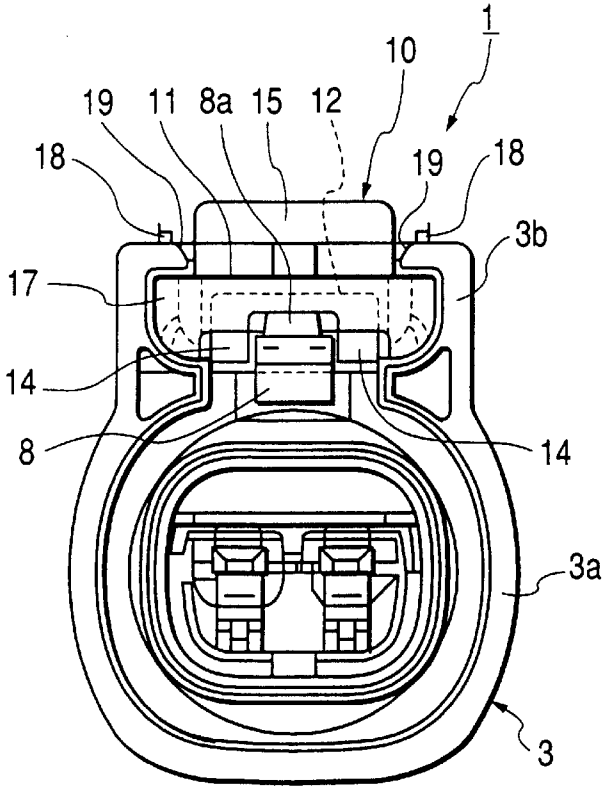

First, the compression springs (spring members) 9 are inserted respectively into the spring receiving portions 3*c* of the slider housing 3*b* (see FIG. 3).

Then, the slider 10 is pushed into the slider receiving portion 4 from the upper side of the housing 3 by pressing the upper surface of the slider 10, as shown in FIG. 3. In this case, the notches 19 are formed respectively in the opposite side edges (which are opposed respectively to the opposite sides of the slider body 11 of the slider 10) of the opening in the upper surface of the slider housing 3*b*, and the slanting guide surface is formed on the upper edge of each notch 19. Therefore, the slider 10 can be easily inserted into the slider receiving portion 4 from the upper side of the housing. At the same time, the hinges 18 are severed.

Figure 4:
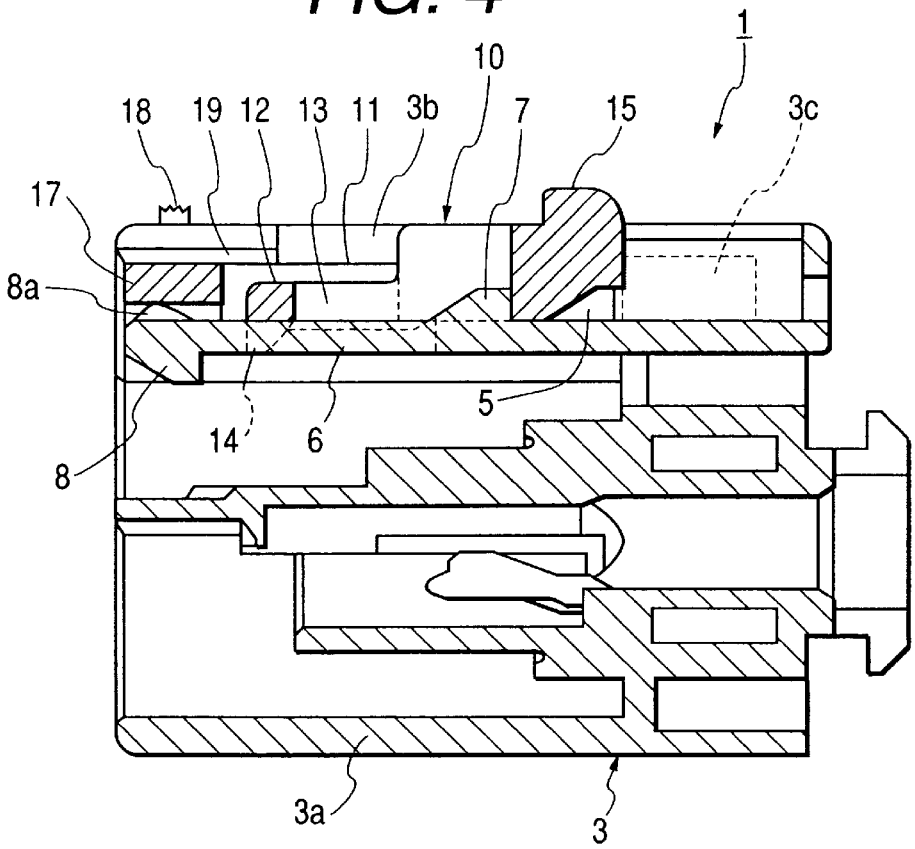
FIG. 4 is a vertical cross-sectional view of the female connector, showing a condition in which the slider, shown in FIG. 2, is completely mounted therein.
Figure 5:
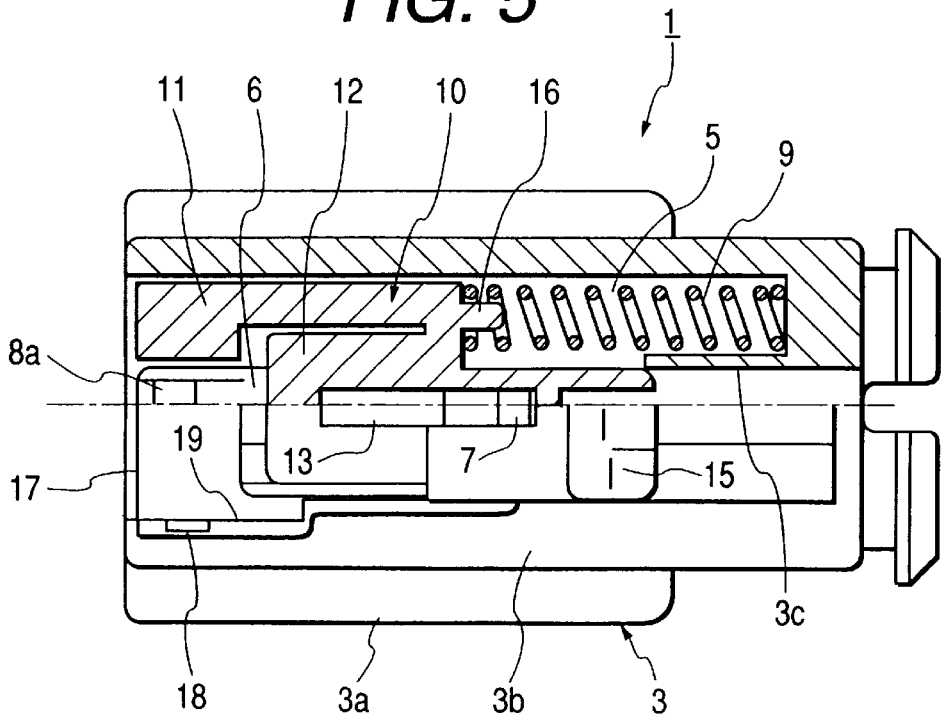
FIG. 5 is a horizontal cross-sectional view of the female connector shown in FIG. 4.

Then, the opposite side portions of the slider body 11 are slid respectively along the guide grooves 5 toward the rear end of the connector (that is, in a right-hand direction in FIG. 3), so that the slider 10 is pushed into a use position in the slider receiving portion 4, as shown in FIGS. 4 and 5. At this time, the abutment projections 14 of the slider 10 are received respectively in the side spaces 4*a* formed respectively at the opposite sides of the lock arm 6. The compression springs 9, held at their one ends on the respective spring retaining portions 16, are received in a compressed condition in the respective spring receiving portions 3*c*, and also the lock beak 7 on the lock arm 6 is fitted in the slide groove 13 in the slider 10, so that the slider 10 is slidably mounted.

Even if the hinges 18 are not severed when the slider 10 is pushed into the slider receiving portion 4, these hinges are severed without fail when the slider 10 is slid toward the rear end of the connector.

In the above condition of the female connector 1 shown in FIGS. 4 and 5, the slider 10 is urged toward the front end of the connector by the resilient force of the compression springs 9, and the front end of the pressing portion 15 is retainingly held against the lock beak 7 in the slide groove 13, and the displacement prevention projections 8*a*, formed at the distal end of the lock arm 6, abut against the displacement prevention portion 17 formed on the lower surface of the slider 10 at the front end thereof, thereby preventing the upward displacement of the lock arm 6.

Then, the socket contacts, each clamped to an end portion of a wire, are inserted into the respective terminal receiving chambers 2*a* from the rear side of the housing 3, and are retained by housing lances, respectively.

If the fitting operation is stopped in a half-fitted condition during the time when the female connector 1 is fitted on the male connector (not shown) as described above for the female connector 21 of FIG. 7, the female and male connectors are returned or moved away from each other (that is, in a disconnecting direction opposite to the fitting direction) by the resilient force of the compression springs 9, and therefore such half-fitted condition can be easily detected.

The completely-fitted condition of the female and male connectors can be detected through the sense of touch, obtained when the housing lock 8 of the lock arm 6 slides over the slanting projection on the male connector, and also can be easily detected by viewing the position of the returned slider 10.

In the female connector 1, the slider 10 is molded integrally with the housing 3, and therefore the number of the molded parts is smaller as compared with the female connector 21 of FIG. 7, and the management for storage of the parts for assembling purposes is simplified.

The hinges 18 can be easily severed merely by pushing the slider 10 into the slider receiving portion 4 from the upper side of the housing 3, and the slider 10 can be easily mounted slidably within the slider housing 3*b*. Therefore, the time and labor, required for arranging the slider 10 in the assembling direction during the assembling operation, can be saved, and the assembling operation can be effected easily.

In the half-fitting prevention connector of this embodiment comprising the female connector 1, a half-fitted condition is positively prevented during the time when fitting the pair of female and male connectors together, and also the production cost can be reduced by reducing the cost for forming the mold and also by simplifying the assembling operation.

The half-fitting prevention connector of the present invention is not limited to the above embodiment, and suitable modifications can be made within the scope of the present invention. For example, in the above embodiment, although the slider housing is provided at the female connector while the stopper projections and so on are provided at the male connector, there can be provided a half-fitting prevention connector of a reverse construction in which a slider housing is provided at a male connector while stopper projections and so on are provided at a female connector.

As described above, in the half-fitting prevention connector of the present invention and the method of producing the same, one housing of the half-fitting prevention connector and the slider are molded in the same mold, and therefore the number of the molds for forming the half-fitting prevention connector is reduced.

The number of the molded parts, constituting the half-fitting prevention connector, is smaller as compared with the conventional half-fitting prevention connector, and the management for storage of the parts for assembling purposes is simplified.

The hinges can be easily severed merely by pushing the slider into the slider receiving portion from the upper side of the housing, and the slider can be easily mounted slidably within the slider housing. Therefore, the time and labor, required for arranging the slider in the assembling direction during the assembling operation, can be saved, and the assembling operation can be effected easily.

Therefore, there can be provided the half-fitting prevention connector and the method of producing the same, in which a half-fitted condition is positively prevented during the time when fitting the pair of female and male connectors together, and also the production cost can be reduced.

What is claimed is:

1. A half-fitting prevention connector comprising:

a pair of connectors;

a spring member received in a housing of one of said two connectors, half-fitted condition of a pair of connectors being prevented by a resilient force of said spring member; and a slider slidably received in said housing, and when said one connector is to be fitted relative to the other connector, said slider cooperates with said spring member to cause a lock arm, provided in said housing, to be retainingly engaged with said other connector, said slider being molded integrally with said housing through severable hinges.

2. A half-fitting prevention connector according to claim 1, wherein said slider is molded integrally with said housing in such a manner that said slider is disposed in a non-use position relative to a slider receiving portion of said housing at a front end portion of the connector, and extends in a sliding direction, and notches for enabling said slider to be inserted into said slider receiving portion from the upper side are formed in an upper portion of a front end portion of said slider receiving portion corresponding to said slider.

3. A method of producing a half-fitting prevention connector including a pair of connectors, a spring member received in a housing of one of said two connectors, a half-fitted condition of said pair of connectors being prevented by a resilient force of said spring member, and a slider slidably received in said housing,, comprising the steps of:

integrally molding said slider with said housing through severable hinges in such a manner that said slider is disposed above said housing, and extends in a sliding direction; and subsequently inserting said slider into said housing receiving said spring member with said hinges being severed, so that said slider is slidably mounted in said housing.

4. A method of producing a half-fitting prevention connector according to claim 3, in which said slider is molded integrally with said housing in such a manner that said slider is disposed in a non-use position relative to a slider receiving portion of said housing at a front end portion of the connector, and extends in the sliding direction, and said slider is inserted into said slider housing through notches formed in an upper portion of a front end portion of said slider receiving portion corresponding to said slider.

* * * * *